US006189706B1

(12) United States Patent
Akins

(10) Patent No.: US 6,189,706 B1
(45) **Date of Patent: *Feb. 20, 2001**

(54) SADDLE BLANKET RACK

(76) Inventor: Brian Akins, Rte. 2 Box 1 Meadow St., Comer, GA (US) 30629

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/039,662

(22) Filed: Mar. 16, 1998

(51) Int. Cl.[7] ..... A47F 5/08
(52) U.S. Cl. ..... 211/87.01; 211/106; 211/85.11
(58) Field of Search ..... 211/87.01, 106, 211/85.11, 181.1, 13

(56) References Cited

U.S. PATENT DOCUMENTS

| | | | | |
|---|---|---|---|---|
| 301,204 | * | 7/1884 | Berry | 211/106 X |
| D. 313,900 | | 1/1991 | Yau Kee | D6/410 |
| D. 316,193 | | 4/1991 | Kee | D6/400 X |
| D. 317,686 | | 6/1991 | Kee | D6/410 |
| D. 327,589 | | 7/1992 | Ma | D6/410 |
| D. 335,399 | | 5/1993 | Hubbard | D6/410 X |
| D. 364,074 | * | 11/1995 | Yeh | D7/637 |
| 572,336 | * | 12/1896 | Dawson | 211/181.1 |
| 840,512 | * | 1/1907 | Palmer | 211/106 X |
| 1,039,694 | * | 10/1912 | Burton | 211/106 |
| 1,630,347 | * | 5/1927 | Luther | 211/106 |
| 2,518,549 | * | 8/1950 | Hyde | 211/106 X |
| 2,760,746 | * | 8/1956 | Botolfsen | 211/85.11 X |
| 2,975,906 | * | 3/1961 | Van Der Togt | 60/347 |
| 3,192,970 | * | 7/1965 | Allen | 211/85.18 |
| 3,305,101 | * | 2/1967 | Mills | 211/85.11 X |
| 4,356,922 | * | 11/1982 | Dierksheide | 211/13 |
| 4,541,535 | * | 9/1985 | Bartholomew | 211/13 X |
| 5,547,088 | * | 8/1996 | Belokin et al. | 211/87.01 |

* cited by examiner

*Primary Examiner*—Daniel P. Stodola
*Assistant Examiner*—Khoa Tran
(74) *Attorney, Agent, or Firm*—Kenneth L Tolar

(57) ABSTRACT

A saddle blanket rack specifically designed for storing and drying a plurality of saddle blankets in a minimal amount of space including a substantially elongated rectangular frame component for attachment to a vertical wall. The frame component includes lateral upper and lower arms with a pair of opposing elongated side arms perpendicularly disposed therebetween. Disposed between the side arms is an elongated intermediate arm. A plurality of rack members are removably attached to the elongated frame component each including an upper beam member having first and second ends with a V-shaped portion perpendicularly extending from a first end thereof. Extending from each terminal end of the V-shaped portion is a side support. The free ends of the rack beam and side supports are removably received within apertures on the frame component side and intermediate arms. Accordingly, a plurality of saddle blankets or similar items may be vertically supported on the device for storage and drying.

1 Claim, 1 Drawing Sheet

SADDLE BLANKET RACK

BACKGROUND OF THE INVENTION

The present invention relates to a uniquely configured rack for storing and drying a plurality of saddle blankets.

DESCRIPTION OF THE PRIOR ART

Horse riders and jockeys often place blankets and similar coverings on the horse's back immediately beneath a saddle. Because these coverings are exposed to moisture, they must be dried to prevent mildew or moisture rot. Typically the blankets will be placed over the top of a fence, a barn wall or a similar object which is unsightly and obtrusive. Blanket and towel racks have been heretofore designed. However, these racks typically have one or more planar rack members on which a plurality of blankets are contiguously stacked. Though these devices suffice for storage, they are inadequate for drying. Accordingly, there is currently a need for a device which can conveniently support a plurality of saddle blankets allowing the blankets to easily dry. Although various blanket and quilt racks exist in the prior art, none have the unique features and advantages of the present invention nor do they relate to a rack uniquely configured to receive saddle blankets. For example, U.S. Pat. No. Des. 335,399 relates to a design for a blanket rack.

U.S. Pat. No. Des. 327,589 relates to an ornamental design for a quilt rack.

U.S. Pat. No. Des. 320,897 relates to an ornamental design for a blanket rack.

U.S. Pat. No. Des. 317,686 discloses an ornamental design for a blanket rack.

U.S. Pat. No. Des. 316,193 relates to an ornamental design for a blanket rack.

U.S. Pat. No. Des. 316,193 discloses an ornamental design for a blanket rack.

Although several ornamental designs for blanket racks exist in the prior art, none relate to a device having a plurality of vertically aligned removably attached blanket receiving racks for storing or drying a plurality of saddle blankets. Furthermore, each rack is specifically designed to elevate a central portion of the blanket with the opposing sides downwardly depending therefrom allowing each blanket to drip dry while exposing the entire surface thereof to ambient air. The unique design of each rack allows a blanket to be securely retained thereon without the need for clamps, hooks and similar attachment means.

SUMMARY OF THE INVENTION

The present invention relates to a saddle blanket rack comprising a substantially rectangular frame component including lateral upper and lower arms with opposing longitudinal side arms perpendicularly disposed therebetween. Between the side arms and parallel thereto is an intermediate arm. At each corner of the frame component is a planar bracket having a plurality of apertures therethrough for receiving a fastener means such as a screw or bolt allowing the frame component to be longitudinally attached to a vertical wall. Removably attached to the frame component are a plurality of vertically aligned rack members. Each rack member includes an elongated upper beam having two opposing ends with an inverted V-shaped member depending from a first end thereof. A side support extends from each terminal end of the V-shaped member that is substantially co-directional with respect to the beam member. The beam member is removably attached to the intermediate arm of the frame component while the side supports are removably attached to the opposing side arms thereof. It is therefore an object of the present invention to provide a saddle blanket rack that is easy to use and inexpensive to manufacture.

It is yet another object of the present invention to provide a saddle blanket rack on which a plurality of saddle blankets may be vertically stacked for drying thereby occupying a minimal amount of lateral space.

It is yet another object of the present invention to provide a saddle blanket rack having a plurality of removable rack members allowing a user to selectively vary the number of racks attached thereto. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
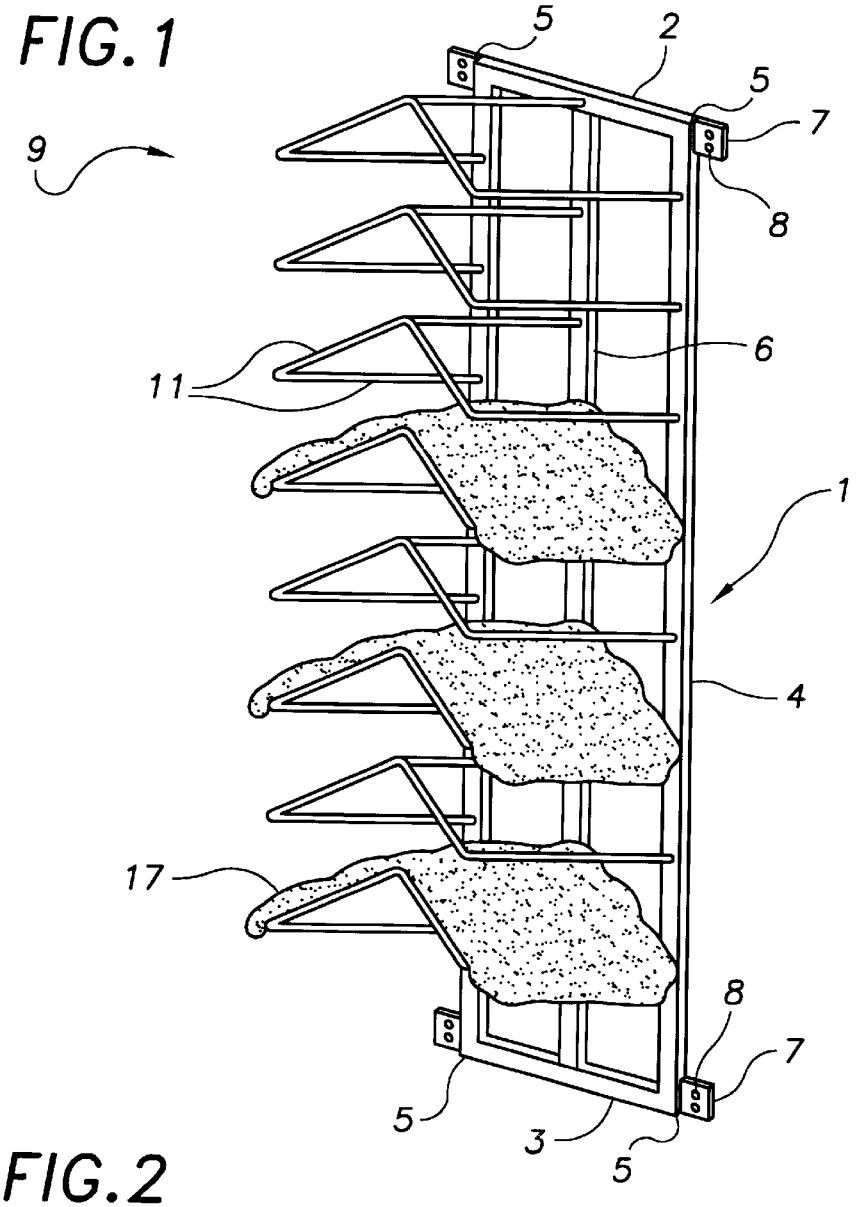
FIG. 1 depicts the inventive device.
Figure 2:
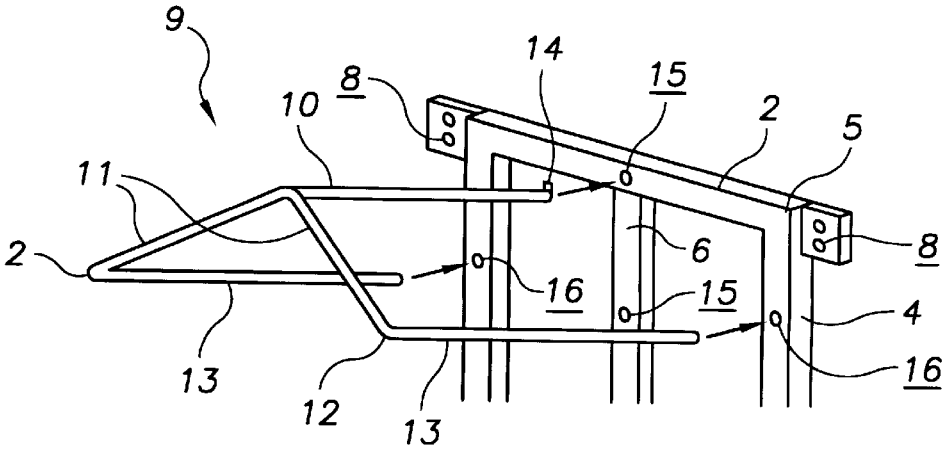
FIG. 2 is a close up view of a removable rack member according to the present invention.

Referring now to FIGS. 1 and 2, the present invention relates to a saddle blanket rack that provides a convenient, compact means for storing and drying a plurality of blankets 17 and similar coverings. The device includes a substantially rectangular, elongated frame component 1 having lateral upper 2 and lower 3 arms and two opposing elongated side arms 4 perpendicularly disposed therebetween. The elongated frame component has a vertical orientation when attached to a wall. The intersection of each lateral and longitudinal arm define a corner 5. Attached to the frame component adjacent each corner thereof is a substantially planar bracket member 7 having a plurality of apertures 8 thereon for receiving a fastener means such as a screw or bolt. Between the two side arms is an elongated intermediate arm 6 parallel thereto.

The device also includes a plurality of substantially roof shaped rack members 9 each including an elongated upper beam 10 having first and second ends. Perpendicularly extending from a first end of the upper beam 10 is a V-shaped portion 11 having a pair of opposing terminal ends 12. Perpendicularly extending from each terminal end and integral therewith is an elongated side support 13 each having a distal end. Each side support is substantially co-directional with respect to the upper beam.

Attached to the second end of the upper beam 10 is an upwardly depending flange for selectively engaging a slot 15 on the intermediate arm of the frame component. Each frame side arm has a plurality of apertures 16 vertically aligned thereon for receiving a distal end of a rack side support. Each aperture on a first side arm is horizontally aligned with an aperture on the second side arm. Each horizontally aligned pair of apertures, however, lie in a separate horizontal plane with respect to the slots. Each pair of opposing apertures and a slot form a substantially triangular configuration. Each rack member 9 may be attached to the frame component 1 by inserting the flange 14 into a slot 15 on the intermediate arm 6. A user may then pivot the rack member downwardly until the distal ends of the side supports seat within their corresponding apertures on the side arms.

Accordingly, a plurality of blankets 17 may each be vertically stored on a discrete rack with ample air space above and below each blanket to allow it to quickly dry. The inverted V-shaped rack members are not only aesthetically pleasing but expose nearly the entire exterior surface of the blanket to ambient air while securely retaining each blanket thereon without the need for clamps, straps or other similar attachment means. Therefore, the vertically stacked blankets will occupy the same amount of lateral space regardless of the number of blankets being stored thereon. The removable rack members also allow a user to vary the number of racks attached to the frame or the spacing therebetween. Furthermore, the device may be easily disassembled for transport or storage.

In the preferred embodiment, the rack members are each made from aluminum tubing having a substantially circular cross sectional configuration and the frame component is made from aluminum tubing having a substantially square cross sectional configuration. Alternatively, the rack members may have a substantially square or rectangular cross sectional configuration. However, as will be readily apparent to those skilled in the art, the materials of construction, the shape, size and relative spacing of the various components may be varied without departing from the spirit of the present invention. Furthermore, the rack members may be attached to the frame using any conventional attachment means such as brackets, bolts, etc. The rack according to the present invention is not limited to storing saddle blankets. The device may also be used to store blankets, bed spreads, tarpaulin and similar large coverings.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A saddle blanket rack comprising:

an elongated, substantially rectangular frame component having four corners, said frame component including upper and lower arms with a pair of longitudinal side arms perpendicularly disposed therebetween, said side arms each including a plurality of apertures thereon, said frame component further including an intermediate arm between said side arms, and said upper arm and lower arm, said intermediate arm including a plurality of spaced slots thereon;

a plurality of substantially roof-shaped rack members removably attached to said frame component, said rack members for supporting a saddle blanket, said rack members each including an elongated upper beam member having first and second ends with a V-shaped portion depending from the first end thereof and an upturned flange disposed at the second end of said upper beam, said flange dimensioned and configured to be removably inserted into one of said slots on the intermediate arm of said frame component, said V-shaped portion having a pair of terminal ends;

an elongated side support perpendicularly extending from each terminal end of said V-shaped portion, each of said side supports substantially parallel to said upper beam member, each of said supports further having a free distal end that is removably received within one of said apertures on said sidearm;

means for attaching said frame component to a vertical wall.

* * * * *